US010488106B2

(12) United States Patent
Golubev

(10) Patent No.: US 10,488,106 B2
(45) Date of Patent: Nov. 26, 2019

(54) METHOD AND APPARATUS FOR PRODUCING COMPRESSED NITROGEN AND LIQUID NITROGEN BY CRYOGENIC SEPARATION OF AIR

(71) Applicant: LINDE AKTIENGESELLSCHAFT, Munich (DE)

(72) Inventor: Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 154 days.

(21) Appl. No.: 15/643,509

(22) Filed: Jul. 7, 2017

(65) Prior Publication Data

US 2018/0017322 A1 Jan. 18, 2018

(30) Foreign Application Priority Data

Jul. 12, 2016 (EP) ..... 16001534

(51) Int. Cl.
*F25J 3/04* (2006.01)

(52) U.S. Cl.
CPC ..... *F25J 3/0429* (2013.01); *F25J 3/0403* (2013.01); *F25J 3/0423* (2013.01); *F25J 3/04309* (2013.01); *F25J 3/04321* (2013.01); *F25J 3/04357* (2013.01); *F25J 3/04381* (2013.01); *F25J 3/04393* (2013.01); *F25J 3/04412* (2013.01); *F25J 3/04448* (2013.01);
(Continued)

(58) Field of Classification Search
CPC .... F25J 3/0429; F25J 3/04412; F25J 3/04357; F25J 3/04309; F25J 2200/20; F25J 2210/40; F25J 2215/04; F25J 2215/42; F25J 2200/54
See application file for complete search history.

(56) References Cited

U.S. PATENT DOCUMENTS 3,375,673 A * 4/1968 Cimler ..... F25J 3/04309 62/650
4,453,957 A * 6/1984 Pahade ..... F25J 3/0429 62/651

(Continued)

FOREIGN PATENT DOCUMENTS

DE 4441920 C1 4/1996
EP 1022530 A1 7/2000

*Primary Examiner* — Brian M King
(74) *Attorney, Agent, or Firm* — Millen White Zelano & Branigan, PC

(57) ABSTRACT

A method and apparatus for producing compressed nitrogen and liquid nitrogen. A separation system has a high-pressure column, a low-pressure column with a top condenser and a main condenser. Air is compressed in an air compressor, purified, cooled in a heat exchanger and introduced into the high-pressure column. A first part of the gaseous top nitrogen from the low-pressure column becomes compressed nitrogen product. A second part of the gaseous top nitrogen is condensed in the condensing space of the top condenser and vapor is drawn off as a residual gas stream. The vapor is expanded in a first expansion machine. A second compressed nitrogen stream from the top of the high-pressure column is expanded in a second expansion machine and then drawn off as compressed nitrogen product. A part of the nitrogen condensed in the top condenser is drawn off as liquid nitrogen product.

20 Claims, 8 Drawing Sheets

Figure 1:
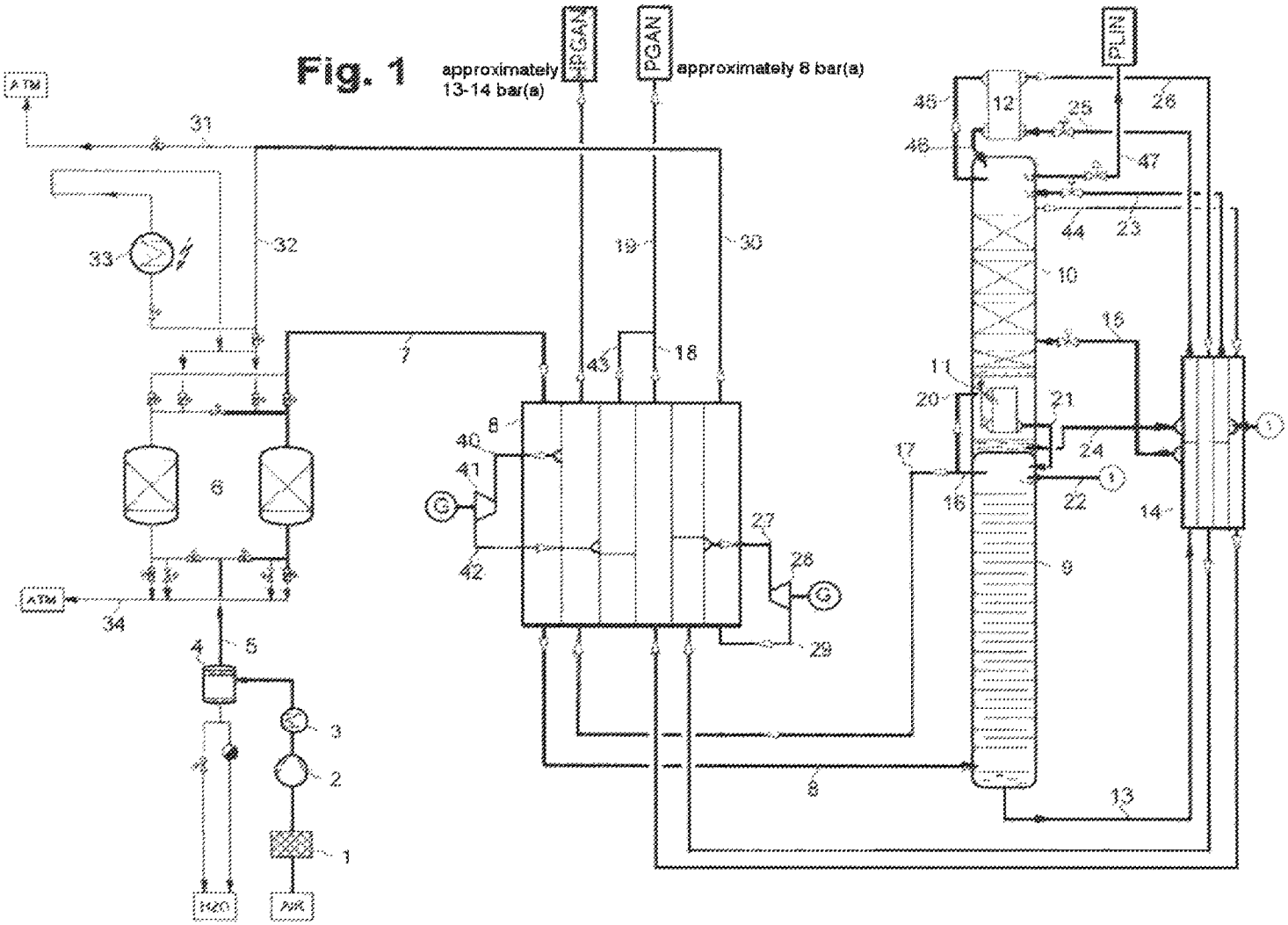

(52) U.S. Cl.
CPC ..... *F25J 3/04745* (2013.01); *F25J 3/04812* (2013.01); *F25J 3/04836* (2013.01); *F25J 3/04854* (2013.01); *F25J 2200/20* (2013.01); *F25J 2200/54* (2013.01); *F25J 2200/94* (2013.01); *F25J 2210/40* (2013.01); *F25J 2215/04* (2013.01); *F25J 2215/42* (2013.01); *F25J 2215/56* (2013.01); *F25J 2250/02* (2013.01); *F25J 2250/20* (2013.01); *F25J 2250/42* (2013.01); *F25J 2270/02* (2013.01)

(56) References Cited

U.S. PATENT DOCUMENTS

| | | | | |
|---|---|---|---|---|
| 4,617,036 | A * | 10/1986 | Suchdeo | F25J 3/0406 62/652 |
| 5,901,576 | A | 5/1999 | Agrawal et al. | |
| 6,694,775 | B1 * | 2/2004 | Higginbotham | F25J 3/0409 62/643 |
| 2005/0126221 | A1 | 6/2005 | Ha et al. | |
| 2010/0242537 | A1 * | 9/2010 | Lochner | F25J 3/04048 62/644 |
| 2011/0083469 | A1 | 4/2011 | Alekseev | |
| 2014/0007617 | A1 * | 1/2014 | Le Bot | F25J 3/04054 62/643 |
| 2016/0187060 | A1 * | 6/2016 | Kirchner | F25J 3/0486 62/644 |
| 2017/0299261 | A1 * | 10/2017 | Narinsky | F25J 3/04024 |

* cited by examiner

METHOD AND APPARATUS FOR PRODUCING COMPRESSED NITROGEN AND LIQUID NITROGEN BY CRYOGENIC SEPARATION OF AIR

The invention relates to a method for producing compressed nitrogen and liquid nitrogen by cryogenic separation of air.

The production of air products in the liquid or gaseous state by cryogenic separation of air in air separation plants is known. Such air separation plants have distillation column systems which can for example take the form of two-column systems, in particular conventional Linde two-column systems, but also three- or multi-column systems. It is also possible to provide apparatus for obtaining other air components, in particular the noble gases krypton, xenon and/or argon (cf. for example F. G. Kerry. Industrial Gas Handbook: Gas Separation and Purification, Boca. Raton: CRC Press, 2006; chapter 3: Air Separation Technology). The distillation column system of the invention can be designed as a conventional two-column system, but also as a three- or multi-column system. In addition to the columns for nitrogen-oxygen separation, it can also have other apparatus for obtaining other air components, for example for obtaining impure, pure or high-purity oxygen or noble gases.

A "main heat exchanger" serves for cooling feed air in indirect heat exchange with recirculation streams from the distillation column system. It can be formed of a single or a plurality of operatively connected, parallel- and/or series-connected heat exchanger sections, for example of one or more plate heat exchanger blocks.

The expression "condenser-evaporator" refers to a heat exchanger in which a first, condensing fluid stream enters into indirect heat exchange with a second, evaporating fluid stream. Each condenser-evaporator has a condensing space and an evaporating space, which consist of condensing passages and, respectively, evaporating passages. The condensation (liquefaction) of the first fluid stream takes place in the condensing space, and the evaporation of the second fluid stream takes place in the evaporating space. The evaporation and condensing spaces are formed by groups of passages which are in a heat-exchanging inter-relationship. The evaporating space of a condenser-evaporator can be designed as a bath evaporator, a falling film evaporator or a forced-flow evaporator.

An "expansion machine" can have any construction. Here, use is preferably made of turbines (turboexpanders).

Conventional two-column methods have just a single condenser-evaporator, the main condenser, and are operated at relatively low pressure, namely just above atmospheric pressure at the top of the low-pressure column. If large quantities of compressed nitrogen are to be obtained, use is made of a modified two-column method, which is operated at higher pressure. This makes it possible to use a low-pressure-column top condenser, and to cool this using an oxygen-rich residual fraction from the distillation column system. Such a method is known from U.S. Pat. No. 4,453,957.

Hitherto, methods of this kind were not considered for appreciable liquid production of more than 5 mol % of the nitrogen product quantity.

The invention is based on the object of indicating a method of the type mentioned in the introduction and a corresponding apparatus, which are suitable for relatively high liquid production of 6 to 10 mol % of the nitrogen product quantity or more, with a relatively high nitrogen product yield in the method of approximately 60%, and which moreover are efficient to run. (The nitrogen yield is dependent on other parameters, for example the product purity.)

This object is achieved with all of the features as described herein

In this context, a second compressed nitrogen stream is drawn off from the top of the high-pressure column and is expanded, in a second expansion machine, to a pressure which still allows this stream to be drawn off as a compressed product, preferably to approximately the pressure of the first compressed nitrogen stream from the top of the low-pressure column. Also, part of the nitrogen condensed in the low-pressure-column top condenser is drawn off as a liquid nitrogen product.

This makes it possible to generate, with minimal additional effort, the cold which is required for the greater liquid production. The second turbine, with a different inlet temperature compared to the first turbine, also improves the temperature profile in the main heat exchanger (lower thermodynamic losses as a consequence of smaller temperature differences).

In the invention, preferably more than 90 mol % of the gaseous nitrogen product is obtained at the same pressure, namely that of the low-pressure column.

Applications are known which require relatively large quantities of liquid product (LIN) in addition to large quantities of compressed nitrogen at approximately 8 bar. These applications include, for example, petrochemical complexes or gas stations with on-site gas supply to clients in the semiconductor industry. In that context, the liquid product is used either to cover spikes in demand (these can be considerable, especially in the case of petrochemical plants) and/or to serve the external liquid market. (The above pressure indication—and all subsequent ones, unless otherwise stated—is to be understood as absolute pressure.)

Hitherto, these objects were achieved for example by using "Spectra" methods (see e.g. U.S. Pat. No. 4,966,002 or 5,582,034) in combination with an external, intermittently-operated condenser. Alternatively, only Spectra plants are used, wherein liquid production is temporarily accomplished at the cost of greatly reduced gas supply. The first case practically requires two plants, which implies particularly high investment costs. In the second case, although only one plant is used, this has very limited capacity for liquid production; especially in the case of 8 bar embodiments, liquid production is not only limited but also inefficient owing to a relatively small pressure gradient in the turbine; it is generally not capable of providing the desired supply of liquid. Furthermore, the efficiency of the Spectra process is relatively low compared to the two-column method used in the invention.

The method according to the invention is particularly expedient to carry out if the first compressed nitrogen stream is drawn off from the top of the low-pressure column at a pressure of 8.0 to 9.0 bar, in particular 8.4 to 9.0 bar.

Preferably, the second compressed nitrogen stream is expanded in the expansion machine to approximately the pressure of the first compressed nitrogen stream; the two compressed nitrogen streams are then united and are drawn off as a common compressed nitrogen product stream. The simplest option is for this unification to take place within the main heat exchanger, although it can in principle also take place in the warmth, that is to say downstream of the main heat exchanger.

The two inlet temperatures of the expansion machines are preferably different in particular the second intermediate temperature is at least 10 K higher than the first intermediate temperature. For example, the temperature difference is between 90 and 30 K, preferably between 70 and 50 K.

In a first variant of the invention, both expansion machines are coupled to a generator or to a dissipative brake. Use is preferably made of generator turbines. Although this does not directly return any energy back to the process, this variant is particularly flexible with respect to different load cases.

Less flexible but more cost-effective is a second variant of the method according to the invention, in which the two expansion machines each drive one compressor stage, and a process stream is compressed sequentially in the two compressor stages. Alternatively, it is possible for just one of the two turbines (for example the compressed nitrogen turbine or "second expansion machine") to be coupled to a compressor stage, and for the other (for example the residual gas turbine or "first expansion machine") to be coupled to a generator.

This process stream can for example consist of one of the following streams:

- At least one part of the purified feed air which is then introduced into the main heat exchanger downstream of the two compressor stages;
- At least one part of the first and/or second compressed nitrogen product stream which is then drawn off as a compressed nitrogen product downstream of the two compressor stages.
- It is in principle possible for both condenser-evaporators to be designed as conventional bath evaporators.

Preferably, however, the low-pressure-column top condenser is designed, on its evaporating side, as a forced-flow evaporator. This produces no loss of hydrostatic pressure on the evaporating side and also a comparatively low pressure on the condensing side.

Alternatively or additionally, the main condenser is designed, on its evaporating side, as a forced-flow evaporator. This produces, in comparison to a bath evaporator, a lower loss of hydrostatic pressure on the evaporating side and also a comparatively low pressure on the condensing side.

In another embodiment of the invention, in the first operating mode, at least one part of the condensed nitrogen is evaporated under pressure and is then obtained as a compressed nitrogen product. The corresponding evaporation device is operated using external heat, that is to say that the heat source is in particular not a process stream of the cryogenic separation system. In the second operating mode, no condensed nitrogen, or only a smaller quantity than in the first operating mode (for example less than 50%), is evaporated in the evaporation device. The evaporation device has, in particular, an air-heated evaporator, a water bath evaporator and/or a solid material cold store.

The invention also relates to a device for producing compressed nitrogen and liquid nitrogen by cryogenic separation of air. The apparatus according to the invention can be complemented by apparatus features which are further described herein.

By way of example, the method according to the invention uses the following pressures and temperatures:

Operating pressures (in each ease at the top of the columns):

- High-pressure column for example 12 to 17 bar, preferably 13 to 15 bar
- Low-pressure column: for example 6 to 10 bar, preferably 7 to 9 bar
- Low-pressure-column top condenser:
  - evaporating space: for example 2 to 5 bar, preferably 3 to 4 bar Air pressures:

- Inlet temperatures for the two turbines (expansion machines):
  - "First intermediate temperature" (residual gas turbine): for example 160 to 120 K, preferably 150 to 130 K
  - "Second intermediate temperature" (nitrogen turbine): for example 220 to 180 K, preferably 210 to 190K.

Figure 2:
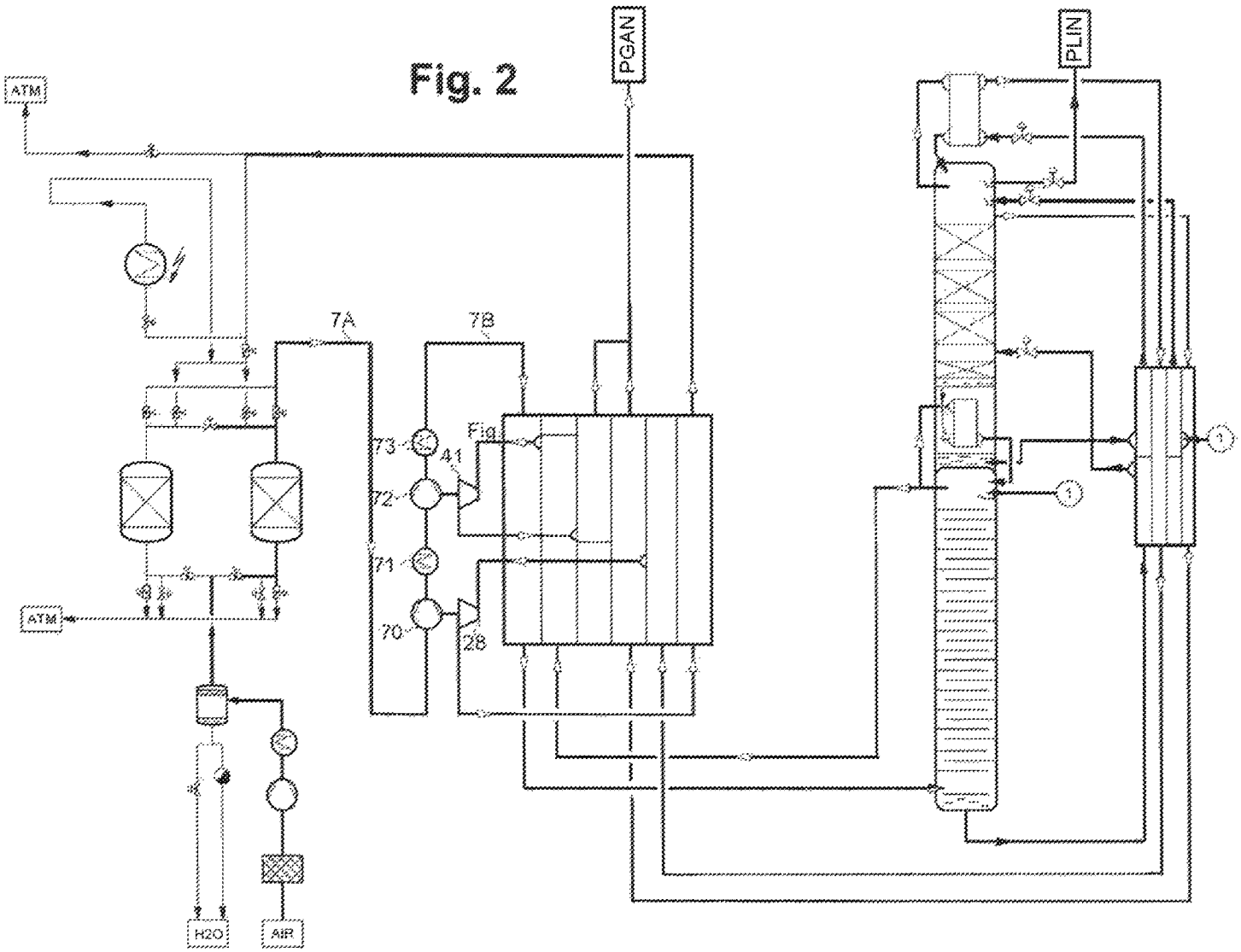
Figure 3:
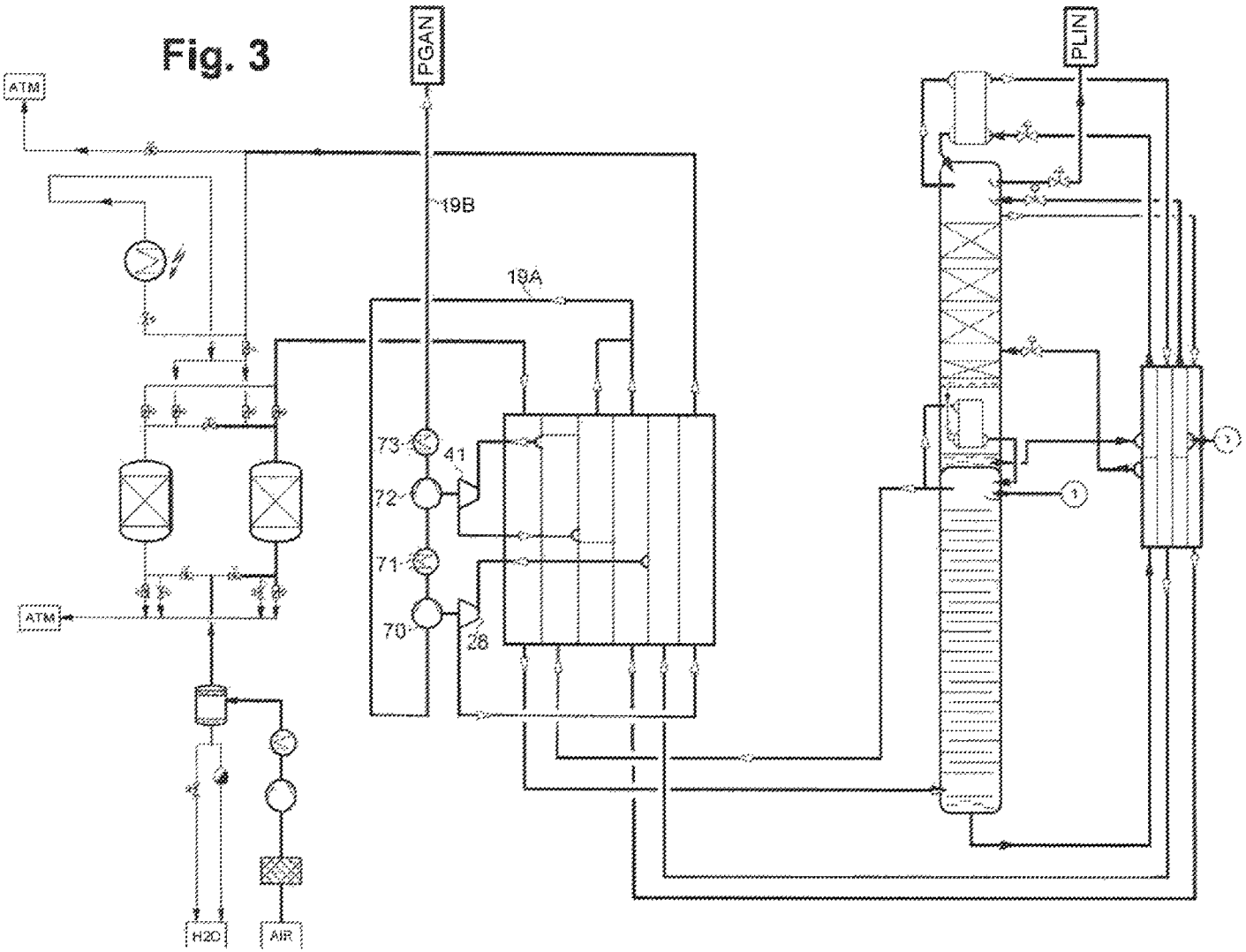
Figure 4:
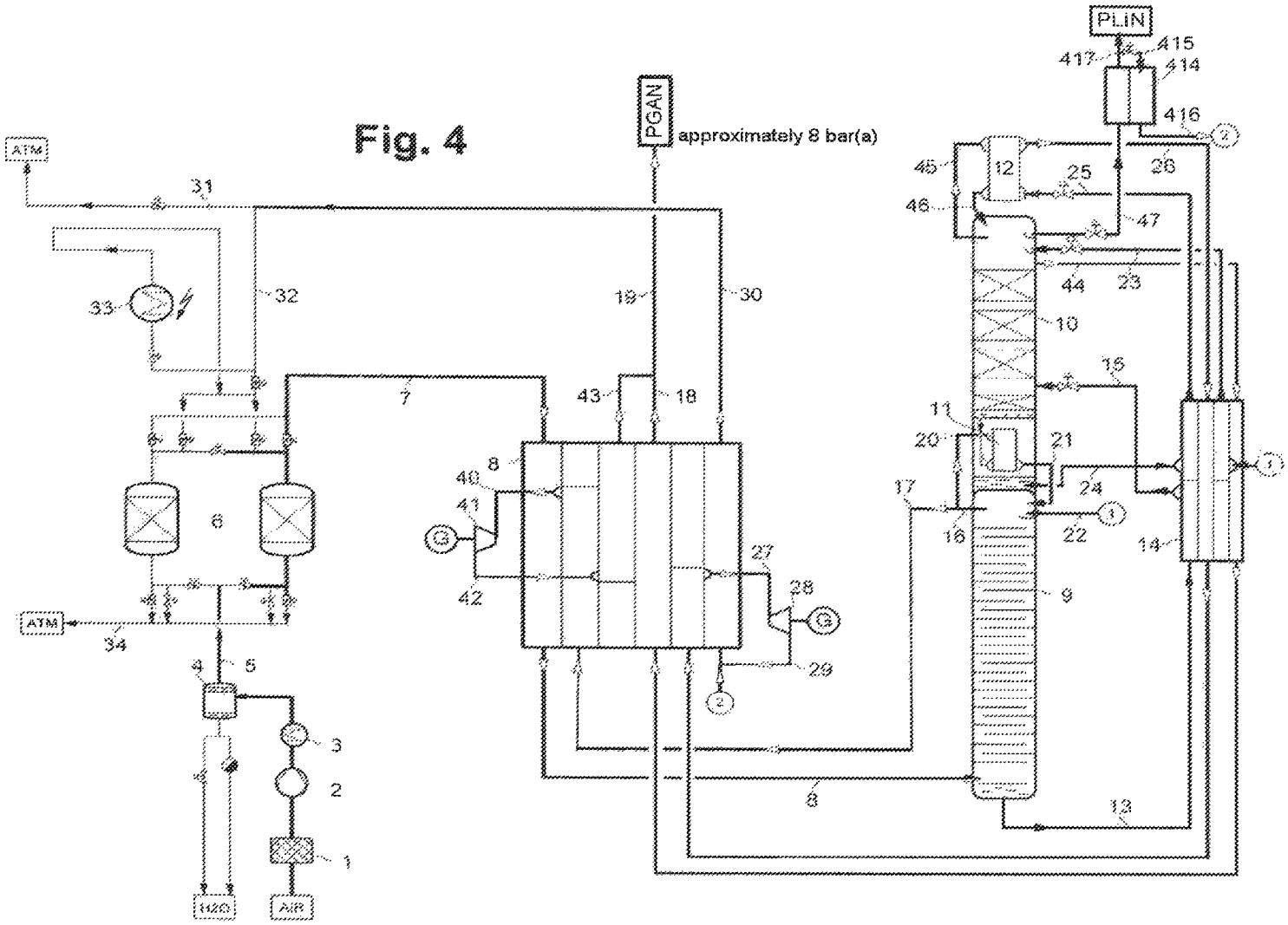
Figure 5:
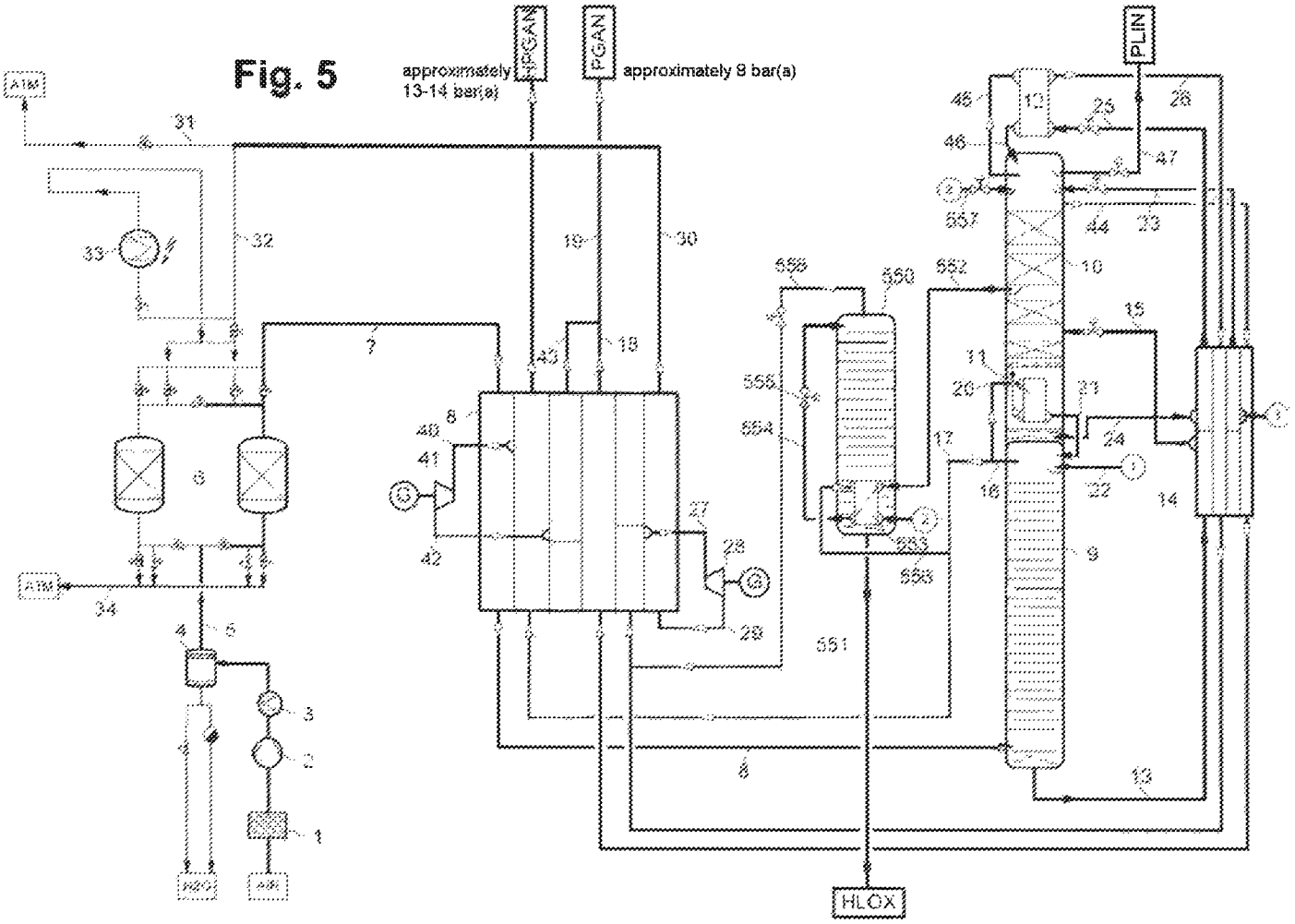
Figure 6:
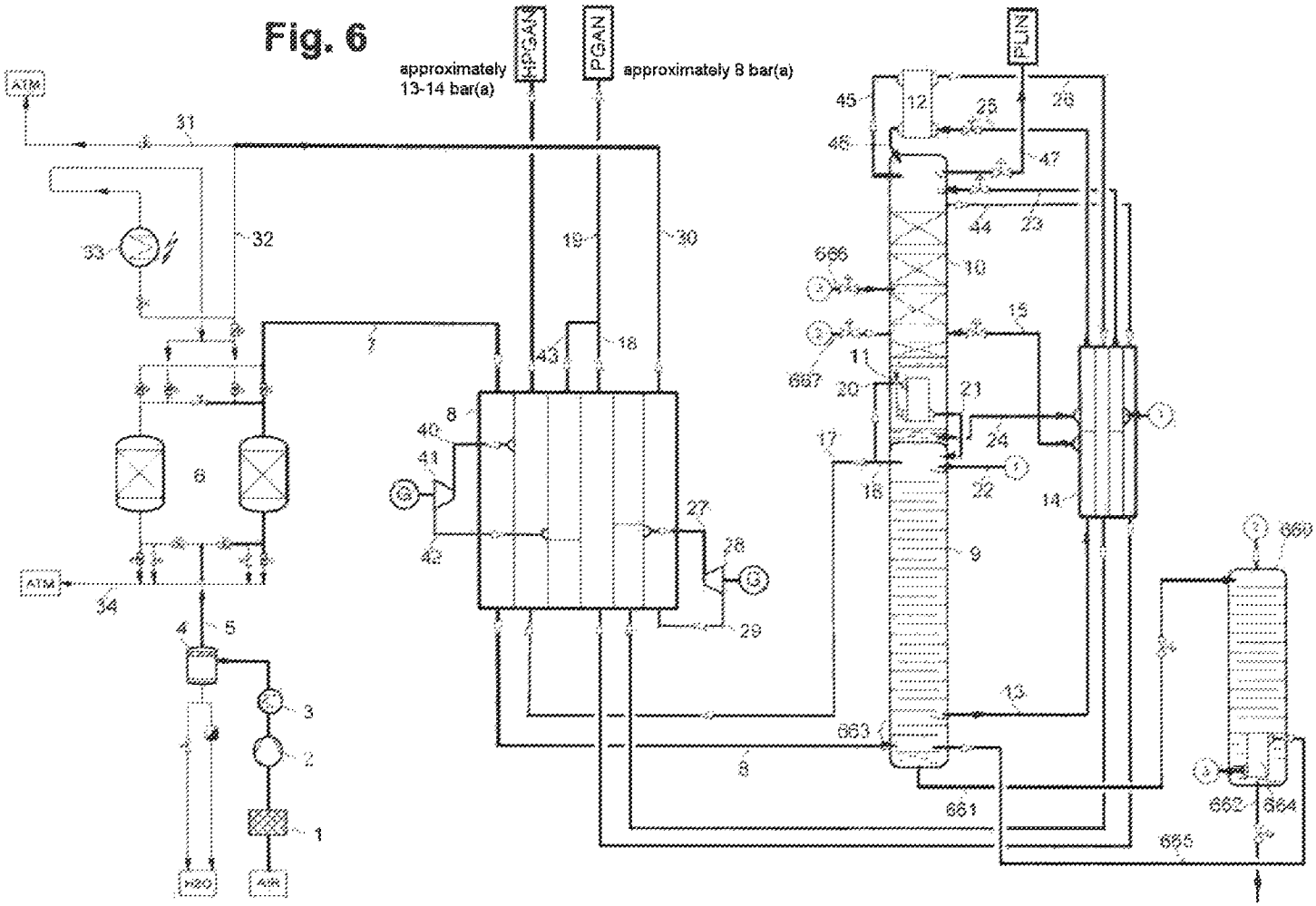
Figure 7:
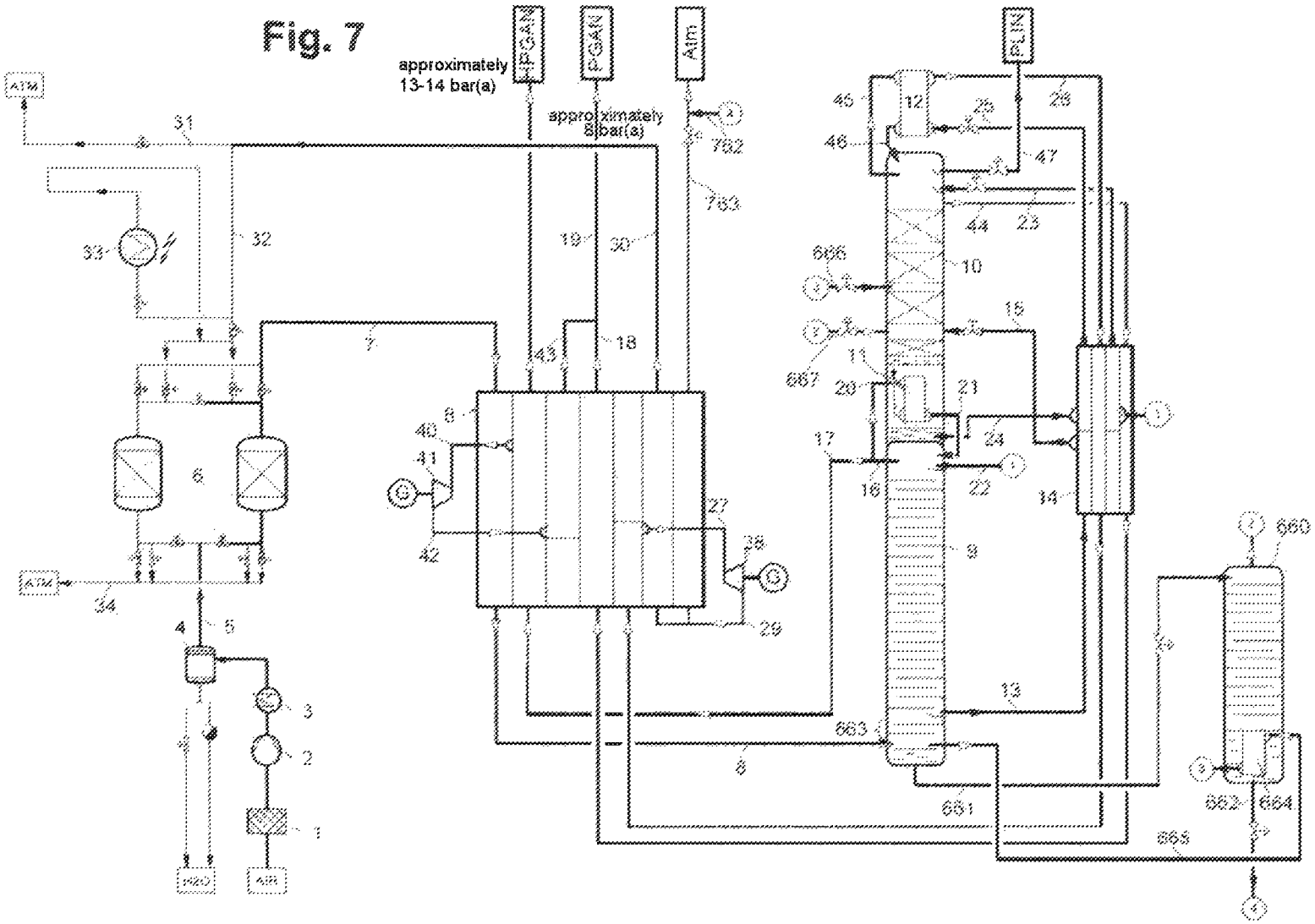
Figure 8:
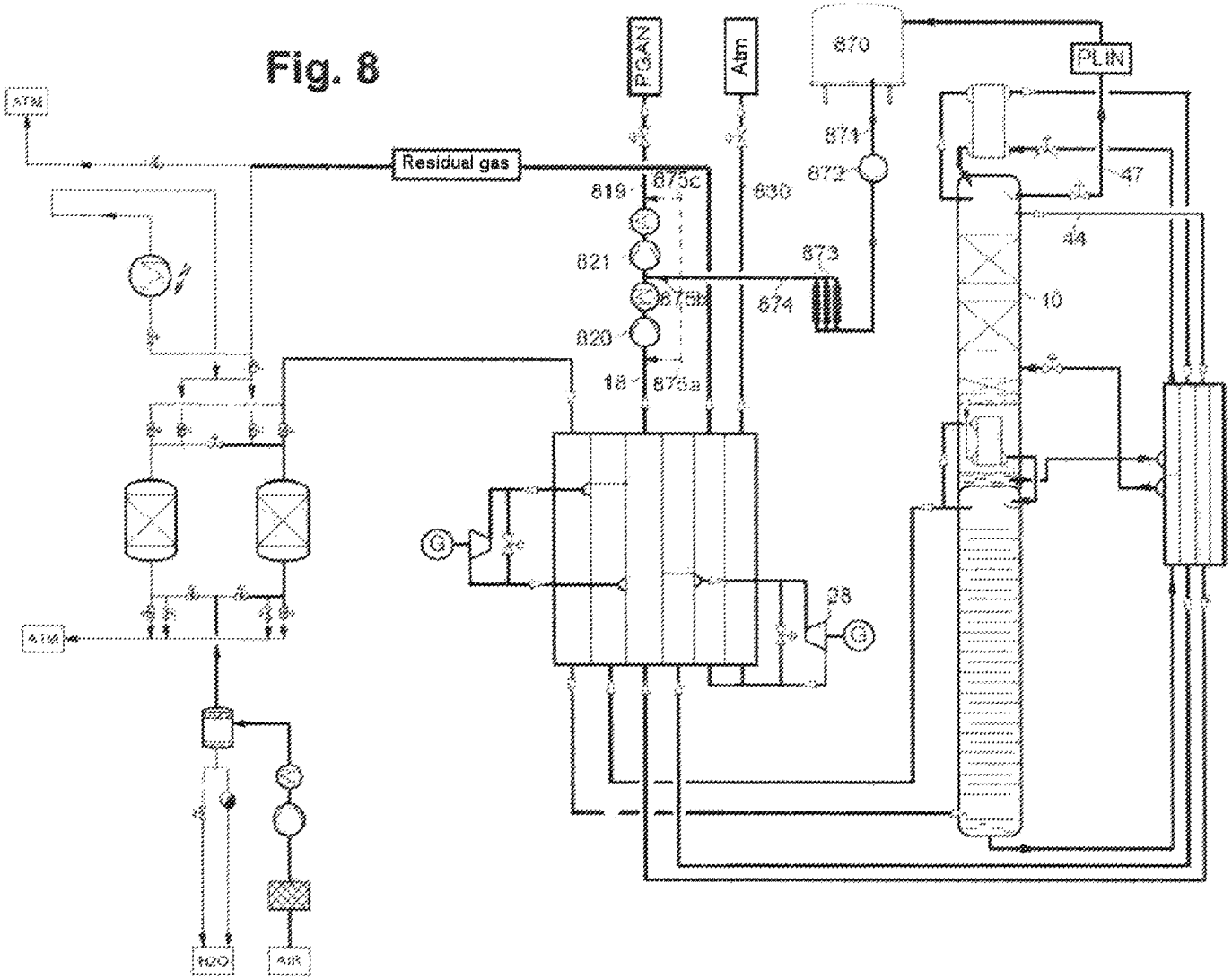

The invention—and further details of the invention—are explained in more detail below with reference to exemplary embodiments represented schematically in the drawings, in which:

FIG. 1 shows a first exemplary embodiment with generator turbines,

FIG. 2 shows a second exemplary embodiment with turbine boosters which are connected in series and compress air, FIG. 3 shows a third exemplary embodiment with turbine boosters which are connected in series and compress nitrogen, FIG. 4 shows a first variant of FIG. 1 with subcooling of the liquid nitrogen product, FIG. 5 shows a second variant of FIG. 1 with obtention of pure oxygen, FIG. 6 shows a third variant of FIG. 1 with an auxiliary column for flushing liquid from the high-pressure column, FIG. 7 shows a modification of the system of FIG. 6, and FIG. 8 shows a system with temporary external evaporation of liquid nitrogen.

In FIG. 1, all of the feed air (AIR) is compressed, via a filter 1, by a main air compressor 2 with aftercooling 3 (and intercooling—not shown), to a pressure of approximately 14.6 bar. The subsequent pre-cooling system has a direct-contact cooler 4. The pre-cooled feed air 5 is fed to a purification device 6, preferably a switchable molecular sieve adsorber.

Line 7 conveys all of the purified feed air (with the exception of relatively small branch-offs, for example for instrument air) to the main heat exchanger 8, where it is cooled on its path to the cold end. The cold, completely or almost completely gaseous air 8 is introduced into the high-pressure column 9. The high-pressure column 9 is part of a distillation column system also containing a low-pressure column 10, a main condenser 11 and a low-pressure-column top condenser 12. Both of the condenser-evaporators 11, 12 are designed, on their evaporating side, as forced-flow evaporators.

Liquid crude oxygen 13 from the sump of the high-pressure column 9 is cooled in a counter-current subcooler 14, and is fed via line 15 to an intermediate point of the low-pressure column 10. A first part 17 of the gaseous top nitrogen 16 of the high-pressure column 9 is drawn off as a second compressed nitrogen stream and is supplied to the main heat exchanger 8. A second part 20 of the gaseous top nitrogen 16 is at least partially condensed in the condensing space of the main condenser 11. A first part of the resulting liquid nitrogen 21 is used as a recirculation flow in the high-pressure column 9. The remainder 22/23 is cooled in the counter-current subcooler 14 and is fed to the top of the low-pressure column 10.

A liquid, oxygen-rich fraction 24 from the sump of the low-pressure column, or from the condensing space of the main condenser 11, is cooled in the counter-current subcooler 14 and is fed, as a coolant stream, via line 25 to the evaporating space of the low-pressure-column top condenser 12 where it is at least partially evaporated. The vapour produced in the evaporating space of the low-pressure-column top condenser 12 is drawn off as a residual gas stream 26 and is heated in the main heat exchanger 8 to a first intermediate temperature of for example 142 K. The residual gas stream 27, at the first intermediate temperature, is fed into a first expansion machine 28, in this case in the form of a generator turbine, where it is expanded, in a work-performing manner, to just above atmospheric pressure. The residual gas stream 29 expanded in a work-performing manner is fully heated in the main heat exchanger 8, that is to say is heated to roughly ambient temperature.

The warm residual gas 30 can be discharged directly to the atmosphere (ATM) via line 31. Alternatively or partially, it can be used, via line 32, as regeneration gas in the purification device 6, possibly after heating in a regeneration gas heater 33. Used regeneration gas is discharged to the atmosphere via line 34.

A first part 44 of the gaseous top nitrogen from the low-pressure column 10 is drawn off as a first nitrogen stream, is heated in the main heat exchanger 8 and is drawn off 18, 19 as a first compressed nitrogen product (PLAN). A second part 45 of the gaseous stop nitrogen of the low-pressure column 10 is at least partially condensed in the condensing space of the low-pressure-column top condenser 12. A part 47 of the nitrogen 46 condensed in the low-pressure-column top condenser 12 is drawn off as a liquid nitrogen product (PUN).

The second compressed: nitrogen stream 17 from the high pressure column 9 is—heated in the main heat exchanger 8 to a second intermediate temperature of 207 K. The second compressed nitrogen stream 40, at the second intermediate temperature, is fed into a second expansion machine 41 where it is expanded, in a work-performing manner, to approximately the operating pressure at the top of the low-pressure column 10. Here, the second expansion machine 41 is also designed as a generator turbine. The second compressed nitrogen stream 42, expanded in a work-performing manner, is fully heated in the main heat exchanger. The warm second compressed nitrogen stream 43 is united with the warm first compressed nitrogen stream 18 and is drawn off via line 19, together with the first compressed nitrogen product, as a second compressed nitrogen product (PLAN).

The methods of both of FIGS. 2 and 3 differ from FIG. 1 in that they use the work performed at the turbines for compressing a process stream. This is brought about by means of two compressor stages (boosters) 70, 72 which are respectively coupled to the turbines 28 and 41 and are connected to one another in series, and which each have one aftercooler 71, 73. In that context, instead of the configuration shown, the compressors and turbines can also be connected in reverse, that is to say that the first expansion machine 41 is coupled to the first compressor stage 70 and the second expansion machine 41 is coupled to the second compressor stage 72.

Optionally, one part 50 of the second compressed nitrogen stream 17 from the high-pressure column 9 can be fed as far as the warm end of the main heat exchanger 8 and can be discharged as a high-pressure product HPGAN at a pressure of 13 to 14 bar (not shown).

In FIG. 2, part of the compression of the total air 7A, 78 is performed by these turbine-driven compressor stages 70, 72. For example, the main air compressor need compress this only to 12.5 bar. Accordingly, the main compressor may have one less stage.

By contrast, in FIG. 3, all of the compressed nitrogen product 19A, 198 is sent through the compressor stages 70, 72. This allows the product pressure to be raised from approximately 8 bar to approximately 11 bar, without it being necessary to supply energy. Thus, this also translates into a cost saving in comparison to using an externally driven nitrogen compressor.

FIG. 4 is identical to FIG. 1 with the exception of an additional counter-current subcooler 414 in which the liquid nitrogen 47 drawn off from the low-pressure column 10 is subcooled against an evaporating nitrogen stream 415/416. To that end, a small part of the subcooled liquid nitrogen is branched off via a valve 417. The evaporated nitrogen 416 is mixed with the exhaust gas 29 from the residual gas turbine 28 and is heated, together therewith, in the main heat exchanger 8.

FIG. 5 contains, in addition compared to FIG. 1, a pure oxygen column 550 the sump of which produces high-purity liquid oxygen which is drawn off via line 551 and is obtained as a high-purity liquid oxygen product HLOX. An oxygen fraction which is free from low-volatility components is drawn off from the low-pressure column 10 via line 552. It is subcooled in the sump evaporator 553 of the pure oxygen column 550 and is sent, via line 554 and throttle valve 555, to the top of the pure oxygen column 550. There, the components with a higher degree of volatility are separated off. Furthermore, the sump evaporator 553 is heated using a part 556 of the gaseous top nitrogen 16 from the high-pressure column 9; the resulting liquid nitrogen 557 is sent to the low-pressure column 10. The impure gaseous oxygen 558 from the top of the pure oxygen column 550 is mixed with the residual gas 26 upstream of the residual gas turbine 28.

In the case of relatively low pressures (for example below 3 bar) in the evaporating space of the low-pressure-column top condenser 12, it is expedient to undertake additional measures, for example the enrichment of propane at an acceptable point in the plant, and the disposal of this enriched liquid from the rectifier system (for example to the ejector, into the surroundings or into the impure nitrogen stream prior to release to the atmosphere). The enrichment can then take place in a known manner directly in the high-pressure column by using the barrier plates.

Because of the relatively high liquid production, the air is already pre-condensed at the inlet into the high-pressure column (for example to a degree of approximately 1% or more). The liquid present owing to this pre-condensation is then separated in the sump and can be discarded together with the flushing liquid. However, this substantially reduces the efficiency of the method since it wastes a lot of cold and also a lot of nitrogen molecules.

A solution to this problem can be found in the method of FIG. 6, which is otherwise also based on the process of FIG. 1. By using an auxiliary column 660 for a high-pressure-column flushing liquid 661 from the high-pressure column 9, it is possible to drastically reduce the flushing quantity which is then drawn off via line 662.

The high-pressure column has one to five practical plates as bather plates 663. The liquid crude oxygen 13 is drawn off above the barrier plates and the high-pressure-column flushing liquid 661 is drawn off below, namely directly from the sump; it contains both the recirculation liquid from the high-pressure column or from the barrier plates, and also the pre-condensed air introduced via line 8. The stream 661 is fed to the top of the auxiliary column 660 (possibly after subcooling), is enriched in low-volatility components during the exchange of material within the column, and is finally drawn off—in substantially smaller quantity—from the sump of the auxiliary column 660 via line 662. The quantity drawn off is for example approximately 40 to 50 $Nm^3/h$; in relative terms, for a total air quantity of 100,000 $Nm^3/h$ the ratio of stream quantities 662 to 661 is for example between 1% and 10%. The sump evaporator 664 of the auxiliary column 660 is heated using gaseous air 665 from the high-pressure column 9. The air 666 condensed in the sump evaporator 664 is fed to the low-pressure column 10. The top gas 667 produced in the auxiliary column 660 is also fed to a suitable point of the low-pressure column 10.

The $C_3H_8$ from the air part stream 665 to the condenser of the auxiliary column 660 is retained in the system. However, this quantity of air is relatively small (approximately 1%) compared to the quantity of feed air, and so operational reliability is not influenced thereby. By virtue of the fact that the flushing 662 is now taken from the auxiliary column 660, it is possible to increase the recirculation quantity to the barrier section 663 in the high-pressure column. Thus, more xenon is flushed out and the actual flushing quantity 662 from the auxiliary column can also be used and processed further as a xenon concentrate; in a method according to FIG. 6, the xenon yield can be above 50%.

Deviating from the depiction in FIG. 6, the high-pressure-column flushing liquid 661 can be subcooled in the counter-current subcooler 14. The liquid stream from the sump evaporator 664 can also be subcooled in the counter-current subcooler 14 before it is fed into the low-pressure column 10.

FIG. 7 differs from FIG. 6 in that the flushing stream 662 is not discarded in the liquid state. Rather, it is fed via line 762 into the warm residual gas line 763 where it evaporates abruptly and is then discharged, highly diluted, into the atmosphere.

The method described hitherto has only limited flexibility in operating situations with relatively low liquid production (that is to say deviating from the design situation). Such cases cause a drop in the pressure in the evaporating space of the upper condenser—and thus also in the inlet pressure into the residual gas turbine and the intake pressure in the case of a possible downstream post-compressor; this relates in particular to the use for blending natural gas in order to adjust the calorific value. However, a significantly reduced intake pressure for the post-compressor has a significant effect on the dimensioning of the machine and also imposes a limit on the normal underload behaviour.

A comparatively cost-effective and yet relatively efficient solution to the situation is possible with the system shown in FIG. 8. In a first operating mode with reduced liquid output, the production of liquid in the plant is not significantly reduced, but rather part of the separating or condensing energy used is recovered from the liquid. This can be brought about either by using an air- or steam-heated emergency supply evaporator or by connecting one or more cold stores. In the latter case, part of the cold of the condensing process is also stored—for example for the purpose of increasing liquid production in other operating situations. In the first operating mode (discharge phase), it is also possible for an air part stream to be condensed.

In the discharge phase, either the power of the main air compressor or the power of the nitrogen product compressor (s) is reduced, or alternatively these remain unchanged and more gaseous product is obtained. It is of course possible for two or three of these measures to be used in combination.

Especially in the case of relatively high product output pressures or intermediate pressures it can be expedient to employ this solution since the saving in terms of compressor power at the product compressor is ever greater with increasing pressure.

In a second operating mode, less or no liquid product is evaporated. For example, those additional method steps which are used in the first operating mode are abandoned.

In contrast to FIG. 1, in FIG. 8 one part 830 of the stream expanded in the residual gas turbine 28 is heated separately before it is ejected into the atmosphere (ATM). The nitrogen product 44, 18 from the low-pressure column 10 is further compressed in the warm by means of two two-stage (820, 821) nitrogen product compressors, before it is discharged via line 819 as compressed product. The product compressor 820, 821 as a whole therefore has four stages. (Alternatively, it is also possible to use one or three nitrogen product compressors with one, three or more stages.) Either all of the compressed stream can be brought to the final pressure, or alternatively part can be extracted (not shown) between the two nitrogen product compressors 820, 821, at an intermediate pressure.

At least part of the liquid nitrogen 47 is stored in a liquid nitrogen tank 870. Preferably, this liquid nitrogen tank 870 also serves for the output of liquid product (not shown in FIG. 8). In the first operating mode, liquid nitrogen 871 is raised in pressure by means of a pump 872 (for example approximately the pressure between the two nitrogen product compressors 820, 821); alternatively, the pump output is at the pressure upstream of the first nitrogen product compressor 820 or at the pressure downstream of the second nitrogen product compressor 821 (not shown). The high-pressure nitrogen is evaporated in an atmospheric evaporator 873; it is also alternatively possible to use a steam-heated water bath evaporator. The gaseous high-pressure nitrogen is mixed, via one of the lines 875*a*, 875*b*, 875*c*, with the warm gaseous nitrogen 18 from the low-pressure column 10.

In a second operating mode, the atmospheric evaporator 873 is shut off and the entire liquid production PLIN is output as end product or is stored in the liquid nitrogen tank 870.

The invention claimed is:

1. A method for producing compressed nitrogen and liquid nitrogen by cryogenic separation of air in a distillation column system having a high-pressure column, a low-pressure column, a main condenser which condenser evaporator, and a low-pressure column top condenser which is a condenser evaporator, said process comprising:

compressing a feed air stream in a main air compressor, purifying the compressed feed air stream, cooling the compressed and purified feed air stream in a main heat exchanger, and introducing the cooled feed air stream into the high-pressure column withdrawing a first part of a gaseous top nitrogen from the low-pressure column as a first nitrogen stream, heating the first nitrogen stream in the main heat exchanger, and removing the heated first nitrogen stream from the main heat exchanger as a first compressed nitrogen product, at least partially condensing a second part of the gaseous top nitrogen from the low-pressure column in a condensing space of the low-pressure-column top condenser, at least partially evaporating a liquid coolant stream in an evaporating space of the low-pressure-column top condenser, withdrawing vapor from the evaporating space of the low-pressure-column top condenser as a residual gas stream, and heating the residual gas stream in the main heat exchanger to a first intermediate temperature, introducing the residual gas stream at the first intermediate temperature into a first expansion machine and expanding the residual gas stream in a work-performing manner, and heating the expanded residual gas stream in the main heat exchanger, withdrawing a second compressed nitrogen stream from the top of the high-pressure column, and heating the second compressed nitrogen stream to a second intermediate temperature in the main heat exchanger, introducing the second compressed nitrogen stream at the second intermediate temperature into a second expansion machine where the second compressed nitrogen stream is expanded in a work-performing manner, heating the expanded second compressed nitrogen stream in the main heat exchanger, and withdrawing the heated second compressed nitrogen stream as a second compressed nitrogen product, and withdrawing a part of nitrogen condensed in the low-pressure-column top condenser as a liquid nitrogen product.

2. The method according to claim 1, wherein the first nitrogen stream is withdrawn from the top of the low-pressure column at a pressure of 8.0 to 9.0 bar.

3. The method according to claim 1, wherein the expanded second nitrogen stream is combined with the first nitrogen stream, and the first compressed nitrogen product and the second compressed nitrogen product are drawn off as a common compressed nitrogen product stream.

4. The method according to claim 1, wherein the second intermediate temperature is at least 10 K higher than the first intermediate temperature.

5. The method according to claim 1, wherein the first and second expansion machines are coupled to a generator or to a dissipative brake.

6. The method according to claim 1, wherein the first and second expansion machines each drive one compressor stage, wherein a process stream is compressed sequentially in the two compressor stages.

7. The method according to claim 6, wherein the process stream compressed sequentially in the two compressor stages consists of at least one part of the compressed and purified feed air cooled in the main heat exchanger.

8. The method according to claim 6, wherein the process stream compressed sequentially in the two compressor stages consists of at least one part of the first and/or second compressed nitrogen product stream.

9. The method according to claim 1, wherein the low-pressure-column top condenser is a forced-flow evaporator.

10. The method according to claim 1, wherein the main condenser is a forced-flow evaporator.

11. The method according to claim 1, wherein an oxygen fraction is withdrawn from the low-pressure column and the oxygen fraction is fed to a pure oxygen column having a sump, wherein a liquid oxygen product is withdrawn from the sump of the pure oxygen column, and wherein the pure oxygen column has a sump evaporator which is heated by at least one part of the oxygen fraction.

12. The method according to claim 1, wherein a high-pressure-column flushing liquid is withdrawn from the high-pressure column and introduced into an auxiliary column which has a sump evaporator, wherein the sump evaporator of the auxiliary column is heated by a part of the compressed and purified feed air stream, and wherein a flushing stream is withdrawn from the sump of the auxiliary column and or sent to xenon extraction.

13. The method according to claim 1, wherein, in a first operating mode, at least one part of the nitrogen condensed in the low-pressure-column top condenser is brought, in a liquid state, to a raised pressure, is evaporated in an evaporation device operated using external heat, and is then obtained as a compressed nitrogen product, and, in a second operating mode, no part of the nitrogen condensed in the low-pressure-column top condenser, or a smaller quantity than in the first operating mode, is evaporated in the evaporation device operated using external heat, wherein the evaporation device operated using external heat has an air-heated evaporator, a water bath evaporator and/or a solid material cold store.

14. An apparatus for producing compressed nitrogen and liquid nitrogen by cryogenic separation of air, said apparatus comprising:

a distillation column system having a high-pressure column and a low-pressure column, a main condenser which is a condenser-evaporator and a low-pressure-column top condenser which is a condenser-evaporator, a main air compressor for compressing a feed air stream, a purification device for purifying the compressed feed air, a main heat exchanger for cooling the purified feed air, means for introducing the cooled feed air into the high-pressure column, means for drawing off a first part of a gaseous top nitrogen from the low-pressure column as a first compressed nitrogen stream, means for heating the first compressed nitrogen stream in the main heat exchanger, means for withdrawing the heated first compressed nitrogen stream as a first compressed nitrogen product, means for feeding a second part of the gaseous top nitrogen from the low-pressure column into a condensing space of the low-pressure-column top condenser, means for feeding a liquid coolant stream into an evaporating space of the low-pressure-column top condenser, means for withdrawing vapor produced in the evaporating space of the low-pressure-column top condenser as a residual gas stream, means for feeding the residual gas stream into the main heat exchanger, means for withdrawing the residual gas stream from the main heat exchanger at a first intermediate temperature, a first expansion machine for work-performing expansion of the residual gas stream withdrawn from the main heat exchanger at the first intermediate temperature, means for heating the expanded residual gas stream in the main heat exchanger, means for withdrawing a second compressed nitrogen stream from the top of the high-pressure column, means for heating the second compressed nitrogen stream in the main heat exchanger to a second intermediate temperature, a second expansion machine for work-performing expansion of the second compressed nitrogen stream withdrawn from the main heat exchanger at the second intermediate temperature, means for heating the expanded second compressed nitrogen stream in the main heat exchanger, means for withdrawing the heated second compressed nitrogen stream as a second compressed nitrogen product, and means for withdrawing one part of nitrogen condensed in the low-pressure column top condenser as a liquid nitrogen product.

15. The method according to claim 1, wherein the first nitrogen stream is withdrawn from the top of the low-pressure column at a pressure of 8.4 to 9.0 bar.

16. The method according to claim 3, wherein the first and second expansion machines each drive one compressor stage, wherein a process stream is compressed sequentially in the two compressor stages.

17. The method according to claim 16, wherein the process stream consists of at least one part of the common compressed nitrogen product stream.

18. The method according to claim 1, wherein an oxygen fraction is withdrawn from the low-pressure column and the oxygen fraction is fed to a pure oxygen column having a sump, wherein a high-purity liquid oxygen product is withdrawn from the sump of the pure oxygen column, and wherein the pure oxygen column has a sump evaporator which is heated by at least one part of the gaseous nitrogen from the top of the high-pressure column.

19. The method according to claim 4, wherein the temperature difference between the second intermediate temperature and the first intermediate temperature is between 30 K and 90 K.

20. The method according to claim 1, wherein the operating pressure at the top of the high-pressure column is 12 to 17 bar, the operating pressure at the top of the low-pressure column is 6 to 10 bar, the first intermediate temperature is 120 to 160 K, and the second intermediate temperature is 180 to 220 K.

* * * * *